United States Patent [19]

Rovin

[11] 4,287,841

[45] Sep. 8, 1981

[54] APPARATUS FOR CUTTING AND HEMMING BED SHEETS AND THE LIKE

[76] Inventor: Herman Rovin, c/o Automatech Industries Inc., Rte. 3 Box 370A, Piedmont, S.C. 29673

[21] Appl. No.: 64,096

[22] Filed: Aug. 6, 1979

[51] Int. Cl.[3] ..... D05B 19/00

[52] U.S. Cl. ..... 112/121.11; 112/307; 112/141; 112/147; 112/130

[58] Field of Search ..... 112/121.11, 121.12, 112/121.15, 121.14, 121.29, 307, 147, 141, 130

[56] References Cited

U.S. PATENT DOCUMENTS

| | | | |
|---|---|---|---|
| 2,546,831 | 3/1951 | Newell | 112/121.11 |
| 2,738,746 | 3/1956 | MacIsaac, Jr. et al. | 112/121.11 |
| 2,834,307 | 5/1958 | Jones et al. | 112/121.11 |
| 3,489,113 | 1/1970 | Flanagan | 112/121.11 X |
| 3,580,198 | 5/1971 | Teed et al. | 112/121.11 |

OTHER PUBLICATIONS

Brochure (undated) of AKAB of Sweden, Copy in Application File, Note Especially the Machine AK144.

*Primary Examiner*—H. Hampton Hunter
*Attorney, Agent, or Firm*—Mandeville and Schweitzer

[57] ABSTRACT

The application discloses a method and apparatus for cutting bed sheets and the like from a large, continuous length of fabric, forming hems on the cut edges of the fabric panels, and then sewing the hems. The fabric is fed "wrong side out", and one of the hems is formed upside down while the other is formed right side up. One hem is formed more or less directly above the other. A pair of sewing machines are mounted one above the other, and the entire fabric panel, with the just-formed hem folds, is advanced laterally through the sewing machines, simultaneously sewing both hems. By arranging for the mounting of both sewing machines, one above the other, servicing of the machines by a single operator is readily accomplished. Moreover, the substantial amount of fabric between the two hems is accommodated in a generally vertically oriented loop of the fabric providing for highly efficient utilization of factory space.

10 Claims, 12 Drawing Figures

APPARATUS FOR CUTTING AND HEMMING BED SHEETS AND THE LIKE

BACKGROUND AND SUMMARY OF THE INVENTION

The manufacture of large fabric panels, such as bed sheets, has been a relatively time consuming and expensive operation, involving substantial amounts of manual labor in the forming and sewing of the hems at each end. In this respect, typically, the fabric utilized in the manufacture of bed sheets, for example, will be woven to a predetermined width, and the selvage edges of the woven fabric will form the finished edges of the bed sheet. The web is cut to predetermined length and hemmed to provide the finished product. Typically, the hemming operation involves the forming of both a large and a small hem at each end, so that the raw cut edges are concealed.

While the forming and sewing of fabric hems by automatic means is a well known art, in general, the application of known automatic techniques to the production of large items, such as bed sheets, has remained rather elusive. Because of the very large size of the fabric panels, equipment heretofore proposed for the simultaneous hem folding and sewing of the opposite ends of a bed sheet has proven to be very large and unwieldy, involving not only substantial investment in the equipment, but also occupying an unduly large area of valuable factory space. Moreover, the geometry of such equipment has made it either very difficult or virtually impossible for a single operator to service sewing machines at opposite sides of the machine, so that additional skilled operating personnel may be required in order to maintain an orderly flow of production. In the past, these practical problems have proven sufficiently great that the economics of automatic hem forming and folding on bed sheets and the like has not been very attractive, and the operation has been carried out largely by manual processes.

In accordance with the present invention, a unique and entirely novel approach is taken to the forming and sewing of hems on large panels, such as bed sheets, which enables reliable, consistent, production operations to be carried out with equipment which is highly attractive economically, in comparison to present methods. With the apparatus of the present invention, the two hems are formed and sewed, one more or less directly above the other, regardless of the length of fabric between the hems, and the intervening material is simply gathered in a generally vertical loop. A pair of sewing machines, one positioned above the other, are located laterally adjacent the feeding and folding sections of the fabric. Once the fabric section is cut to length and the hems are folded, the entire unit is held and laterally transferred in a novel and advantageous manner, to be described, and conveyed past the sewing machines for the sewing operations to take place.

In accordance with one of the more specific aspects of the invention, the fabric is fed generally vertically downward into the hem folding section, in a "wrong side out" orientation. The lower hem is folded upside down, and the upper hem, after severing of the section to length, is folded rightside up. The entire fabric section is then controllably transferred laterally through the sewing machines.

In accordance with another specific aspect of the invention, a unique and simplified arrangement is provided for engaging the fabric after initial formation of the hem folds and controllably transferring the fabric laterally, without losing the hem folds. The transfer means both clamps and laterally advances the fabric, and takes the place of the feed dogs of the sewing machines, which are rendered inoperative. In addition, the transfer means are sufficiently responsive to enable high speed sewing and back tacking, as is appropriate in a commercial production sewing operation.

In accordance with a further specific aspect of the invention, a novel arrangement of fabric supporting and guiding plates is provided which accommodates a generally vertically downward, gravity movement of the fabric into precisely measured limit positions to accommodate the necessary cutting and hem folding operations. Thereafter, selected ones of the guide plates are movable into new positions more appropriate for supporting of the fabric during the lateral transfer and sewing operations.

For a more complete understanding of the above and other significant features and advantages of the invention, reference should be made to the following description of a preferred embodiment of the invention, and to the accompanying drawings.

DESCRIPTION OF A PREFERRED EMBODIMENT OF THE INVENTION

Figure 1:
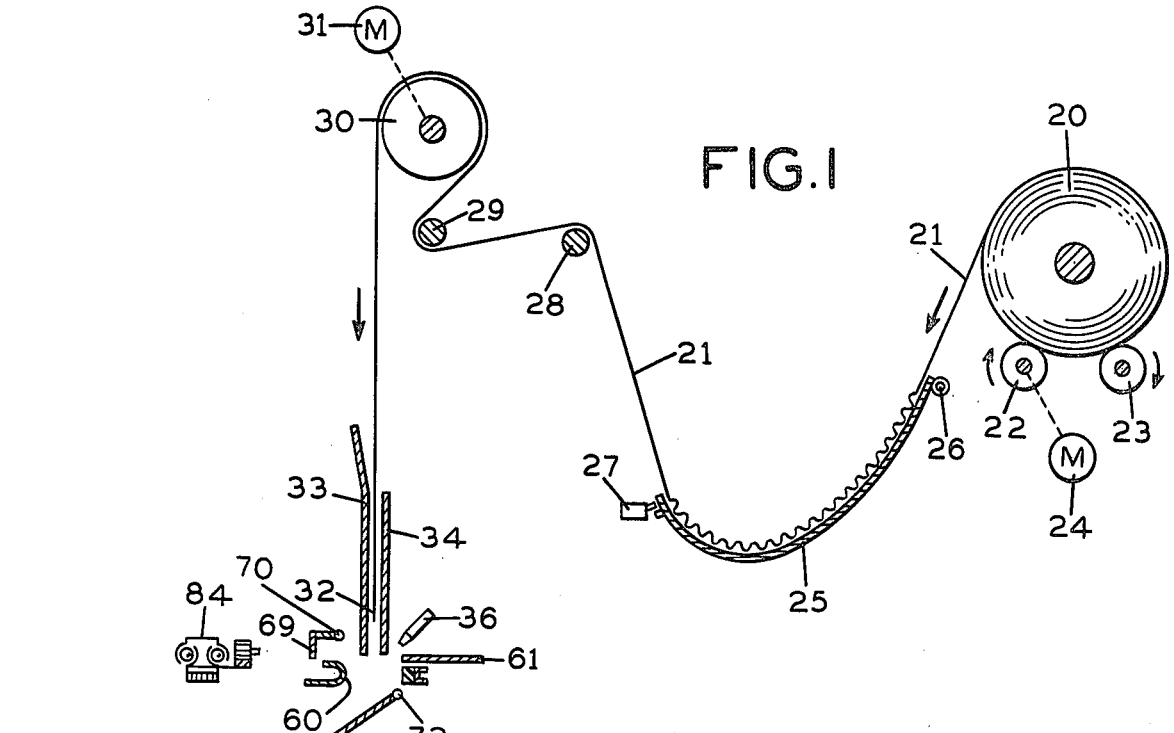
FIG. 1 is a schematic illustration of the apparatus of the invention, shown in condition prior to the start of the feeding, folding and sewing of a large panel, such as a bed sheet.

Referring now to the drawings, and initially to FIG. 1, the reference numeral 20 designates a supply roll of fabric web, which may typically contain as much as two thousand yards of fabric, for example. In some cases, the fabric 21 on the roll may be folded in half, lengthwise, in which case appropriate unfolding equipment (not shown) needs to be incorporated in the overall system. For the purpose of this disclosure, however, it is assumed that the fabric 21 is open width.

The roll 20 typically is supported on a pair of rollers 22, 23, at least one of which is driven by a motor 24. In order to draw fabric from the roll supply 20, the motor 24 is driven in the appropriate direction and the fabric 21 is directed into the pan of a scray 25. The scray pan is pivoted at 26 and is yieldably urged to pivot in the upward direction. A suitable switch 27 is actuated by upward pivoting movement of the scray pan and serves to energize the motor 24 to advance fabric into the pan. When the weight of the fabric in the pan is sufficient to pivot the scray pan downwardly, the switch 27 opens and the motor 24 is de-energized.

From the scray pan 25 the fabric 21 is led over guide rollers 28, 29 and then over and around a driven feed roller 30 controlled by a motor 31. The feed roller 30 is operated in accordance with the demands of the feeding, folding, cutting controls on the downstream side of the feed roller. As the feed roller draws fabric from the scray pan 25, reducing the weight load thereon, the pan eventually lifts sufficiently to trip the switch 27 and reactivate the infeed drive motor 24. Thus, the energizing and de-energizing of the drive motors 24, 31 are independent, although of course related.

In the infeed section of the equipment, that is on the upstream side of the feed roller 30, provisions are made for precisely aligning the edges of the fabric 21. To this end, a mechanism of the type shown and described in the Rovin et al. pending U.S. Application Ser. No. 938,335, owned by Automatech Industries Inc., may be employed. Insofar as necessary or appropriate, the disclosure of that application is incorporated herein by reference. The edge aligning means there illustrated is in the form of rollers arranged to engage the edge margins of the fabric at each side, and canted at a slight angle to the axis of advancement of the fabric. When an edge is detected to have wandered laterally out of its tolerance range, one or the other of the canted rollers is caused to press upon the fabric as it continues to advance longitudinally. The canted roller, pressing on the fabric, biases the fabric toward that edge to restore the web to its proper alignment, after which pressure on the canted roller is released.

In FIG. 1, the apparatus is shown in the ready condition, prior to the commencement of a sheet forming operation. In that condition, the cut lower end 32 of the fabric web hangs by gravity from the discharge side of the feed roll 30. The lower free portion of the fabric is guided and confined between a pair of vertically disposed upper guide panels 33, 34, which extend across the full width of the folding section of the machine, being of sufficient width to accommodate the maximum width of fabric web to be processed. At the initiation of a sheet-forming operation, the motor 31 is energized to drive the feed roller 30 and advance the fabric. The leading edge of the fabric, under the influence of gravity, engages a downwardly inclined deflector panel 35, which guides the fabric downward and forward. Air nozzles 36 may be momentarily activated during this feeding phase to assist in the downward and forward deflection of the fabric and to overcome the effects of friction.

Figure 2:
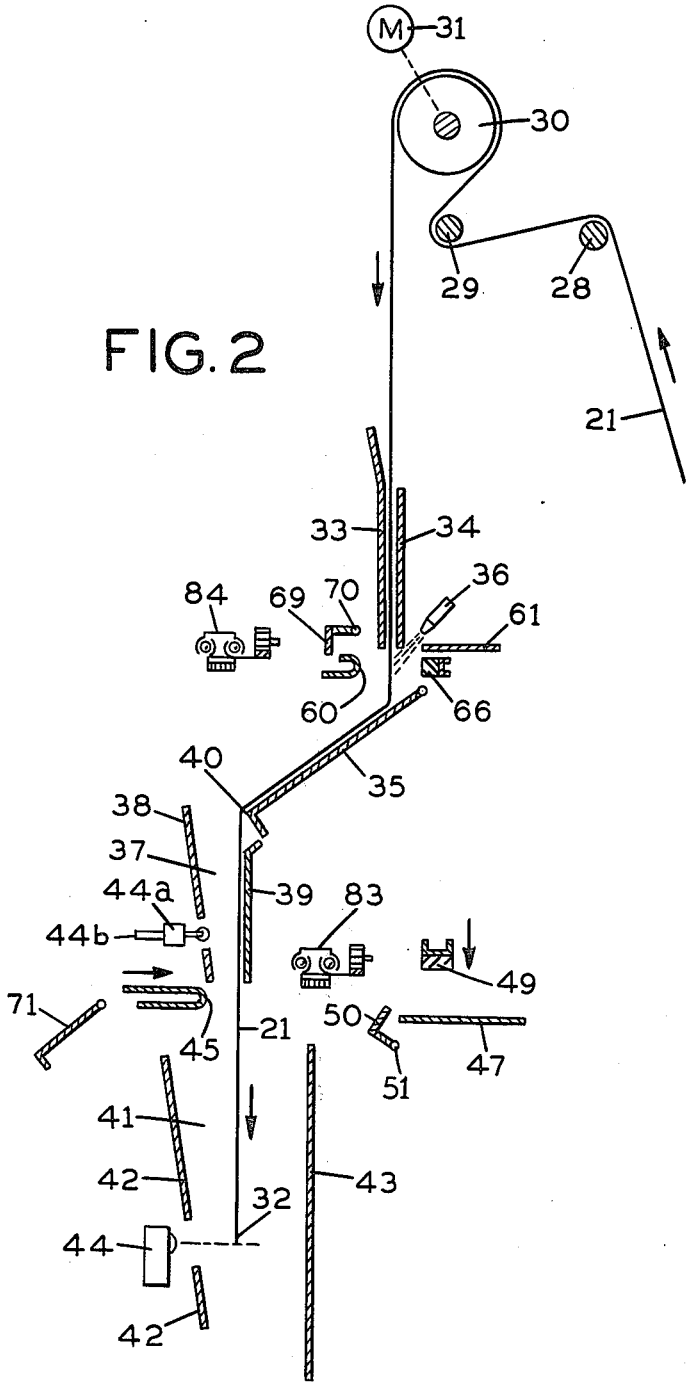
FIG. 2 is a schematic view, similar to FIG. 1, illustrating the fabric after feeding into a first limit position in preparation for a hem folding operation at one end.

As the fabric reaches the end of the inclined deflector panel 35, it enters a generally vertical guide space 37 (see FIG. 2) defined in part by intermediate front and back guide panels 38, 39 and in part by the lower forward extremity 40 of the deflector panel 35. Downward advancing movement of the fabric 21 continues until the fabric enters a lower generally vertical guide space 41 defined by front and back lower guide panels 42, 43. At an appropriate location in the lower guide space 41, edge detector means, preferably in the form of a pair of widely spaced photocells 44, are provided to detect the advance of the edge extremity 32 of the fabric web. In the illustrated arrangement, when the photocell beams are interrupted, the feed motor 31 is de-energized stopping the feed roll 30 and establishing a reference position for the lower edge 32 of the fabric from which hem folding operations may commence. Desirably, control provisions are made for the feed roller 30 to be driven at relatively high speed (e.g. 36 inches per second) to a level just a few inches above the photocells 44. At that level, the feed roller 30 is decelerated to a much slower speed (e.g. 6 inches per second) so that substantial precision may be realized in the final location of the edge 32.

To ensure greater precision in the forming and sewing of the lower hem, the photocells 44 are arranged in widely spaced relationship, one more or less adjacent each side edge of the web. If the leading edge of the fabric is not perfectly horizontal as it approaches the photocell level, the photocell at one side is tripped first, and that energizes a solenoid 44a and causes its plunger 44b to move into clamping relationship with that side of the fabric. The downward feeding of the web as a whole continues until the similar photocell at the opposite side has its beam broken which energizes a similar solenoid and plunger to clamp the web in its opposite edge region. Actuation of the second solenoid also serves to stop the feeding roll 30. Although, theoretically, the lower edge of the fabric should at at all times be perfectly square to the horizontal, practical realities are such that this may not always occur. Thus, the combination of spaced photocells and solenoids assures that the hem is properly formed in all cases, even though, in some cases, the finished sheet may not be perfectly square. In this respect, the fact that the sheet as a whole may be slightly out of square is not easily detectable and is thus quite tolerable, whereas even minor misalignments in a relatively narrow hem may be easily noticeable.

After the leading edge 32 of the web has reached its lower limit position, the first hem folding operation commences. The folding is commenced by the front to back, generally horizontal movement of a U-shaped folding bar 45, which is disposed in the region between the bottom edges of the intermediate guide panels 38, 39 and the top edges of the lower guide panels 42, 43. The folding bar 45 advances from a position in front of the fabric web 21 to a position well in back of the web. In so moving, the folding bar picks up the web and carries it rearwardly. Since the upper part of the web is held fixed by the now motionless feed roll 30, the lower extremity 32 of the fabric is drawn upwardly, as necessary, to accommodate the rearward horizontal movement of the folding bar.

Figure 3:
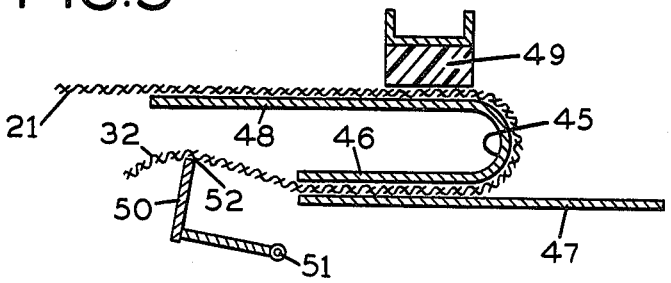
FIGS. 3 and 4 are highly enlarged, fragmentary, schematic illustrations showing the manner of folding the first hem of the panel.
Figure 4:
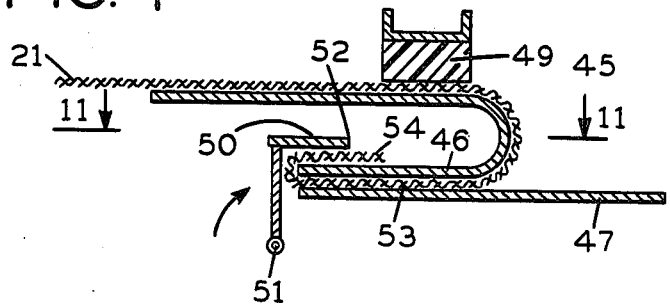

As reflected in FIGS. 3 and 4, as the folding bar 45 nears its rearward limit position, the lower panel 46 thereof passes over the top of a horizontal folding blade 47, causing the end extremity of the fabric to be folded upward, horizontally, against the lower panel of the folding bar. The fabric also rests by gravity upon the horizontal upper panel 48 of the folding bar, as indicated in FIGS. 3 and 4. When the folding bar has reached its rearward limit position, a clamping member 49 is brought downward against the fabric resting on the upper folding bar panel 48, effectively locking the fabric against the folding bar.

As reflected in the drawings, a small hem folding blade 50 is pivotally mounted at 51, generally in front of the horizontal folding panel 47. When the lower hem folding bar 45 advances in a rearward direction, it passes over the small hem folding blade 50, drawing the fabric end extremity 32 over the edge 52 of the blade. When the large hem folding bar 45 has reached its limit position, an end margin of the fabric remains draped over the small hem folding bar, as shown in FIG. 3. At this stage, the small hem folding blade is actuated to pivot about its axis 51, carrying the end margin of the fabric upward and rearward over the top of the lower hem folding panel 46, substantially as shown in FIG. 4.

As will be understood, the hem folds thus described include a large hem fold, formed by the fabric section 53, and a small hem fold (often referred to as a tuck-under), formed by the fabric section 54. In general, and taking into consideration final dimensional adjustments incorporated into the procedure and to be hereinafter described, the length of the large hem section 53 is determined by the horizontal extent of the lower panel 46 of the hem folding bar, and the length of the small hem section is determined by the left-over margin of fabric which is folded upward and rearward by the pivoting bar 50. Provision may be made for forming hems of different size by interchanging of the large hem forming bar 45 with other bars having longer or shorter lower panels 46, as will be understood. To accommodate such changes in hem width, provision is made for vertical adjustment of the position of the photocell detectors 44, so that the stop position of the fabric edge extremity 32 may correspond appropriately with the width of the hem to be formed.

Figures 5, 12:
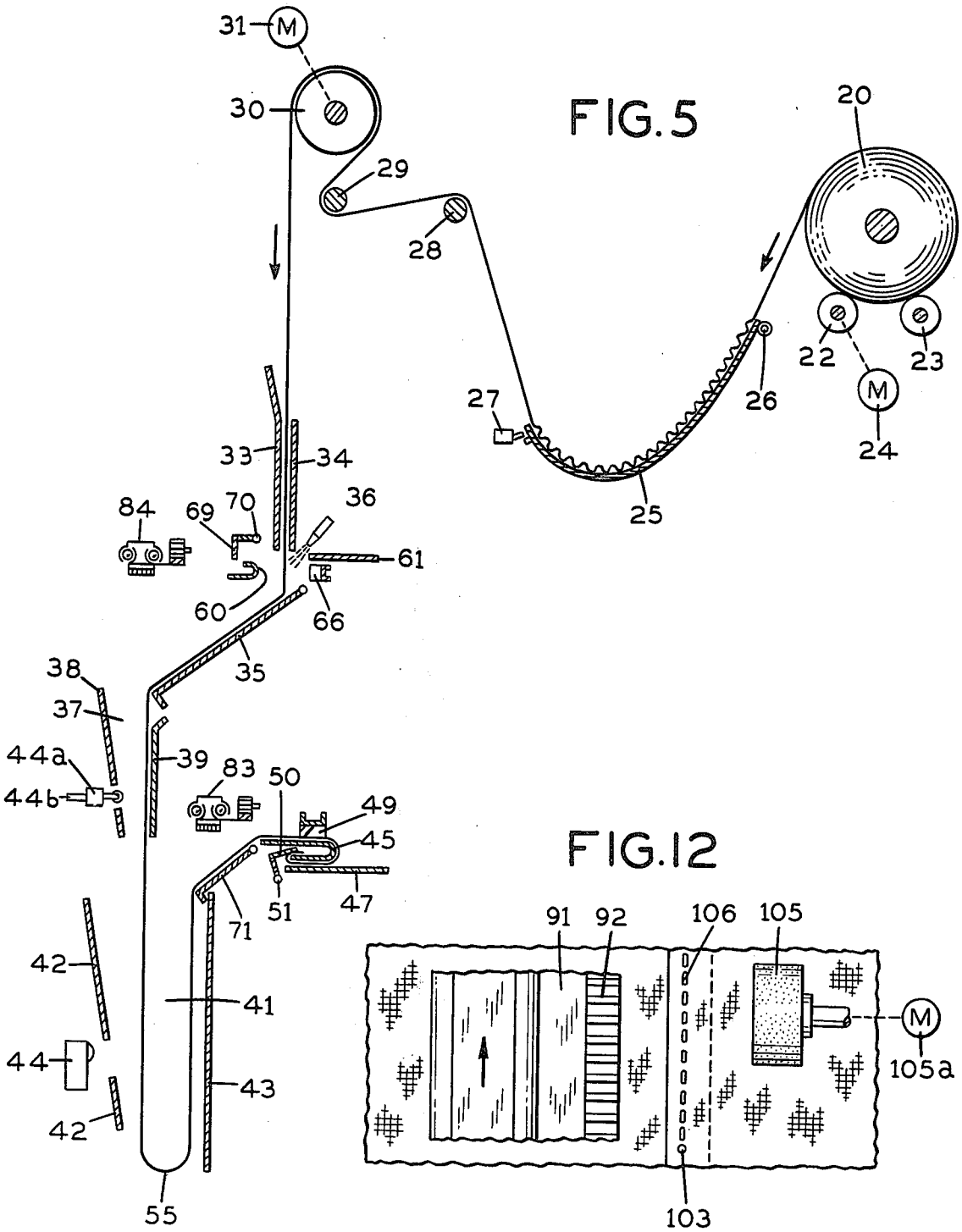
FIG. 5 is a schematic view, similar to FIG. 1, illustrating the further feeding of the fabric panel after forming of the first hem fold.
FIG. 12 is a top plan view illustrating arrangements for feeding of the fabric in the region of the sewing needle.

After forming of the lower hem, the folding elements remain in the position indicated in FIG. 4 during further operations of the equipment, including a further feeding operation to provide a sheet of predetermined measured length, and operations necessary to effect folding of the upper hem. Thus, after completion of the lower hem folding operation, the feed motor 31 is reactivated to rotate the feed roller 30 and advance the fabric 21 downward through the upper guide panels. The fabric moves along the deflector panel 35 and then down through the intermediate guide panels and down into the guide space 41 defined by the panels 42, 43. The guide space 41 is open at the bottom, so that the fabric can collect therein as a loop 55, as required to provide a fabric section of the desired length. In this respect, control over the length of the fabric section advantageously is achieved by means of an electronic integrator system (not shown), typically an analog type, associated with the drive motor 31. The control arrangement, which per se may be more or less conventional, provides for the summing and integration of pulses proportional to rotational increments of the motor 31. After accumulation of a predetermined number of pulses, the motor is decelerated from its relatively high speed of advance to a lower speed, and then stopped altogether, with the accumulated pulses corresponding rather accurately to a web section of preselected length. The condition of the equipment at this stage is substantially as illustrated in FIG. 5.

Folding and forming of the upper hem, and severing of the web section to length, is initiated by horizontal movement, in a front to back direction, of an upper hem folding bar 60, in conjunction with back to front horizontal motion of a cooperating folding blade 61. In the illustrated form of the invention, and as particularly reflected in FIG. 6, for example, the upper hem folding bar 60 advances through the vertical guide plane formed by the upper vertical guide panels 33, 34, so as to deflect the fabric 21 toward the rear. In conjunction, the folding blade 61 moves from back to front through the guide plane, to deflect the fabric horizontally over the top panel 62 of the folding bar 60.

Figure 6:
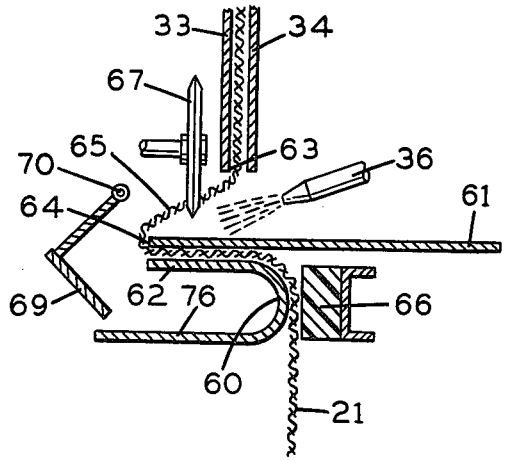
FIGS. 6 and 7 are schematic illustrations, similar to FIGS. 3 and 4, but showing the cutting of the fabric and the folding of the second hem.
Figure 7:
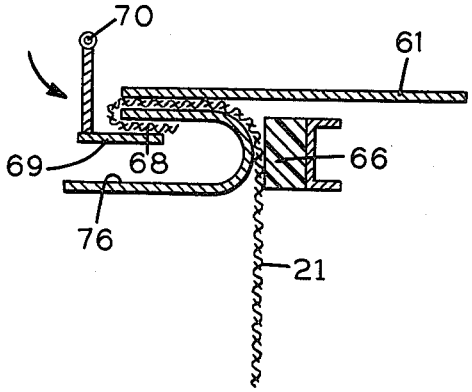

As reflected particularly in FIG. 6, the weight of the hanging fabric causes the material to be held relatively taut between the lower edge 63 of the guide panel 33 and the forwardmost edge 64 of the folding panel 61. A small vertical space is provided between the lower edge of the guide panel 33 and the upper surface of the folding blade 61, so that a short section 65 of the fabric extends downward and forward at an angle. With the folding bar 60 in its rearwardmost position, it is in contact with a clamping bar 66, which serves to hold the upper margins of the fabric against the folding bar 60. At this stage, the cutting wheel 67 traverses the taut, angular fabric section 65, severing a fabric section from the main supply. The short section of fabric to the left of the cutting knife 67, as shown in FIG. 6, forms the small hem section 68, after downward and rearward pivoting of a small hem folding blade 69, which is mounted on a pivot axis 70. After the initial folding operations, the upper hem is in a partially completed condition, substantially as shown in FIG. 7 of the drawing.

Figures 8, 10:
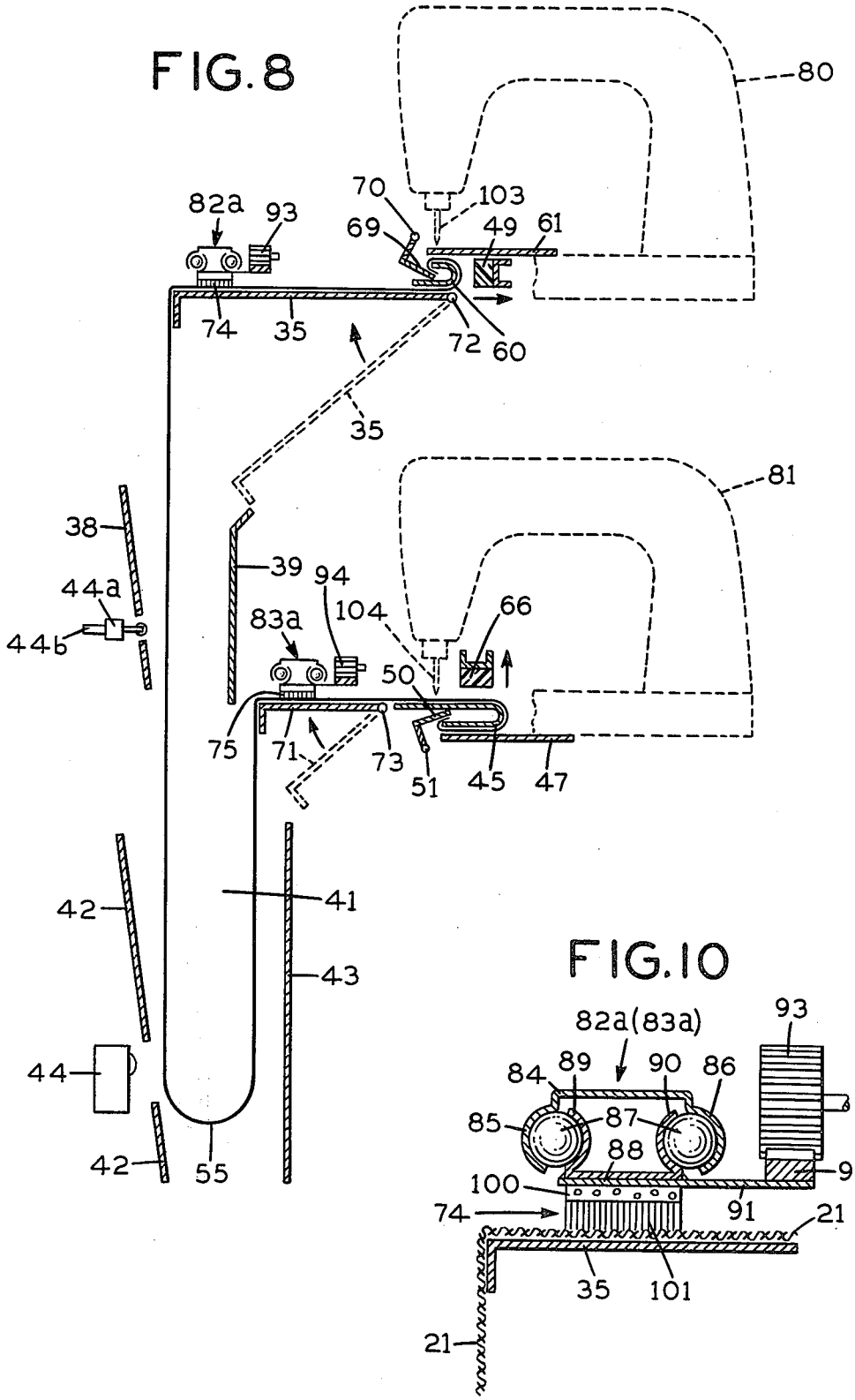
FIG. 8 is a schematic view illustrating the position of the sewing machines and showing certain fabric driving panels of the apparatus reoriented into appropriate positions for the lateral transfer of the severed and folded web section for the sewing operation.
FIG. 10 is an enlarged, fragmentary cross sectional view as taken generally on line 10—10 of FIG. 9, illustrating details of the fabric transfer mechanism forming an important feature of the invention.

In accordance with one of the features of the invention, the deflector panel 35 and a similar, downwardly inclined guide panel 71 are pivotally mounted at their upper, rearward edges 72, 73 respectively, accommodating upward pivoting movement of the respective panels into generally horizontal positions as illustrated in FIG. 8. The panels 35, 71, like the other panels previously described, extend the full width of the fabric. Accordingly, when the panels 35, 71 are pivoted upwardly, they carry with them the overlying sections of fabric and bring them into contact with elongated, transversely disposed transport strips 74, 75. The upper deflecting panel 35, in addition to bringing the fabric into contact with the transport strip 74, also completes the forming of the upper large hem, by lifting the fabric up closely adjacent to the lower panel 76 of the upper hem folding bar 60, as clearly reflected in FIG. 8.

In the condition of the system shown in FIG. 8, the fabric is clamped across its full width by the fabric transport strips 74, 75, pressing against the respective panels 35, 71. At this juncture, therefor, the respective fabric hem clamps 49, 66 are released. However, since the hem fold areas of the fabric are isolated from the weight of the fabric by the transport strips 74, 75, the respective hem folds remain in their as-folded condition.

As shown in FIG. 8, and in accordance with one of the significant aspects of the invention, the upper and lower hems of the fabric are located in generally vertical alignment, one above the other, with sufficient space between to accommodate the presence of the lower of two sewing machines 80, 81.

Figure 9:
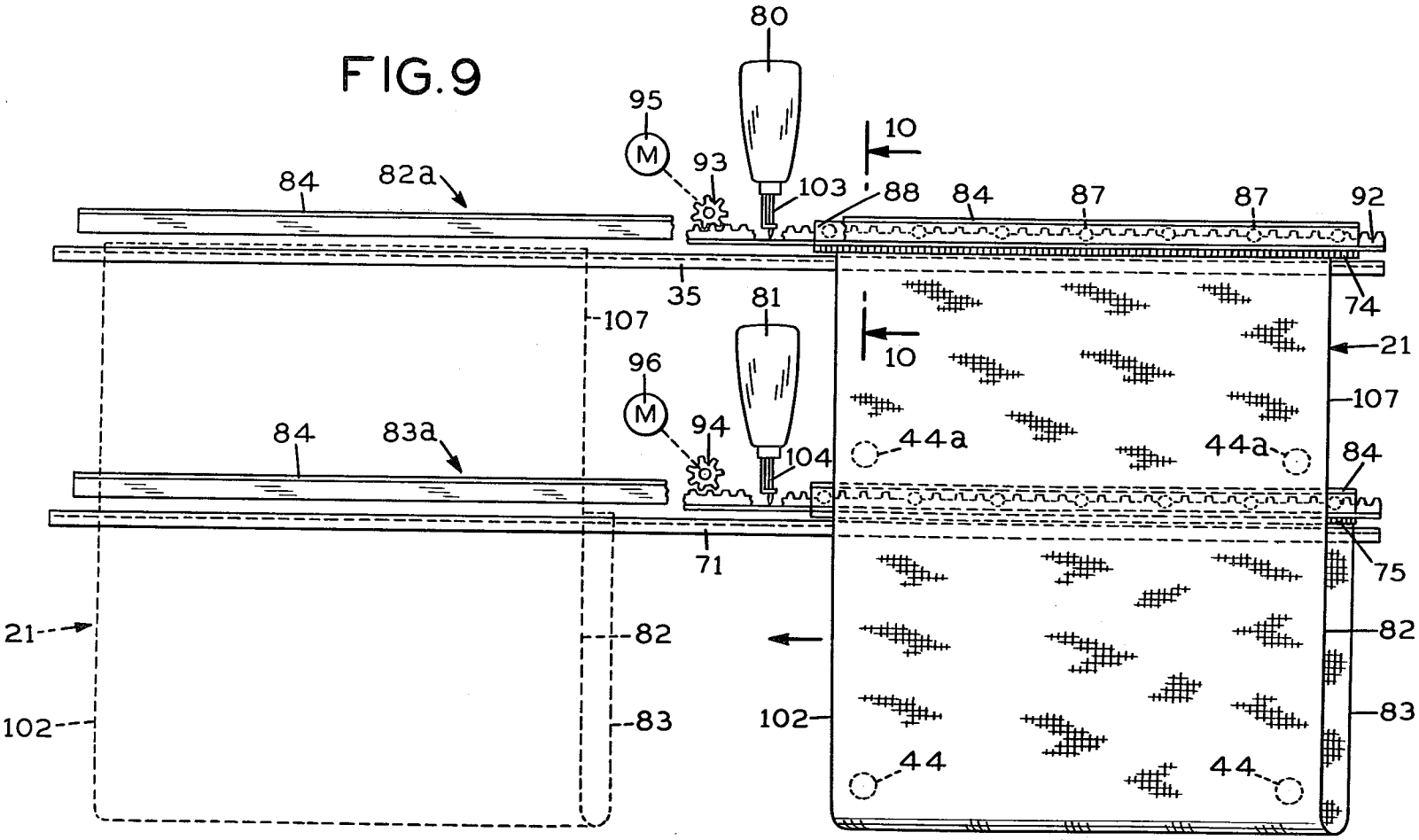
FIG. 9 is a simplified front elevational view of the apparatus of the invention showing the positions of the sewing machines and illustrating the fabric in its initial position, for folding of the hems, and in its final position, after lateral transfer for sewing.

As reflected in FIG. 9, the location of the sewing machines is laterally adjacent the fabric 21, after severing thereof from the supply roll and forming of the hems. In FIG. 9, the fabric edges 82, 83 are shown as being laterally offset for purposes of illustration only, it being understood that, in actual practice, these edges properly are aligned one directly behind the other.

As reflected in FIG. 9, the pivoting panels 35, 71 extend not only for the full width of the fabric section, but also for a substantial distance beyond, sufficient to support the fabric during transfer through the sewing station and beyond, to an unloading station reflected by the broken line illustration of the fabric at the left in FIG. 9. Lateral conveyance of the fabric is achieved in accordance with the invention by means of elongated, ball bearing slide tracks 82*a*, 83*a*. FIG. 10 illustrates details of the slide tracks, which may be substantially identical in construction. There is provided an upper track section 84, which extends for the full width of the apparatus, that is, through the feeding and folding position, shown at the right in FIG. 9, across and over full width of the unloading position, shown at the left in FIG. 9. The upper track 84, which is rigidly mounted horizontally, is provided with opposed, inwardly opening, generally semi-cylindrical ball grooves or races 85, 86, in which are contained a plurality of bearing balls 87. A lower track section 88, of a length just slightly greater than the maximum width of a fabric section to be handled in the equipment, is received in the upper track section and has opposed, outwardly facing, generally semi-cylindrical tracks 89, 90, which cooperatively receive the bearing balls 87.

The upper and lower tracks 84, 88, in cooperation with the bearing balls 87, form a lightweight, low friction, horizontal slide mechanism, in which the lower track section 88 may be moved laterally from the feeding and folding side to the unloading side, to convey the fabric through the sewing stations. Desirably, the low friction slide arrangement may be substantially similar in construction to more or less conventional anti-friction drawer slide arrangements, for simplicity and economy in manufacture.

As reflected in FIG. 10, there is secured to the lower track or slide member 88 a bracket 91, which carries at its rearward extemity an elongated gear rack 92. The rack 92 for each slide track cooperates with a drive pinion 93 or 94, suitably located adjacent the sewing machines 80, 81 and driven respectively by motors 95, 96. As reflected in FIG. 9, for example, the racks 92 would extendsufficiently far to the left of the lower track sections 88 to be able to engage the pinions 93, 94 when the tracks 88 are in their right-hand limit positions. When the motors 95, 96 are energized, the pinions are rotated to drive the racks 92 to the left, sufficient to carry the tracks 88 over to left-hand limit positions reflected by the dotted line position of the fabric 21 in FIG. 9.

Secured to the bottom of the lower anti-friction track 88, and extending along its full length, are the respective transport strips 74, 75, heretofore mentioned. To advantage, these transport strips may be elongated, narrow sections of a material such as foam-backed pile carpeting material, for example, with the foam layer 100 being bonded to the rack supporting bracket 91 and the pile yarns 101 projecting downward. The upper surface of the supporting panels 35, 71 is, of course, sufficiently smooth to permit free lateral sliding movement of the fabric 21 thereover. Accordingly, when the fabric is brought into light pressure contact with the downwardly projecting pile yarns 101, as reflected in FIG. 10, for example, the fabric is effectively gripped across its full width and is readily transported laterally without slippage or distortion by controlled lateral movements of the anti-friction track 88.

In the procedure of the invention, after forming and folding of the upper and lower hems, the drive motors 95, 96 are activated to controllably advance the anti-friction tracks 88 and their respective transport strips 74, 75 laterally for sewing of the hems and transport of the finished product to the unloading position. The sewing operation desirably involves a short back tack, then sewing of the full hem, followed by a finish back tack at the other edge. To this end, the transport strips 74, 75 are driven to carry the leading edge 102 (see FIG. 9) of the sheet to and slightly beyond the sewing needles 103, 104, which are desirably aligned in the same vertical plane as viewed from the front of the equipment, reflected in FIG. 9. If a one inch back tack is desired, for example, the fabric edge 102 is moved to position one inch beyond the sewing needles, at which point each sewing machine presser foot is lowered to its sewing position. The controls for this purpose may, for example, be a photocell edge detector in conjunction with an integrating circuit of generally known type.

Pursuant to the invention, the feed dogs of the sewing machines 80, 81 are disabled, so that feeding of the fabric is entirely under the control of the transport strips 74, 75, augmented by auxiliary, synchronized friction wheels 105 associated with each of the sewing machines and located on the opposite side of the stitch line 106 (see FIG. 12) from the transport strips. The friction wheels 105 are driven by separate, variable speed motors 105a, which can be controlled to run synchronously with, or slightly faster or slower than, the transport strips 74, 75 for greater control over the sewing operation. Desirably, there are also suitable means (not shown) for varying the pressure of the friction wheels on the fabric.

After the fabric is first fed into the starting position, the sewing machines are activated and the transport drive motors 95, 96 are activated in reverse, to retract the fabric section 21 (toward the right in FIG. 9) to form the back tack. The direction of the drive motors 95, 96 is thereupon reversed and the fabric is conveyed to the left by the transport strips, carrying the full width of the fabric section past the sewing station and thus sewing the upper and lower hems across their full width. By means of the integrating circuit arrangement and/or by suitable photocell detectors, the trailing edge 107 of the fabric is detected as it approaches the vertical plane of the sewing needles 103. When the stitch line reaches the trailing edge extemity 107 of the fabric, the drive motors 95 are automatically reversed in direction to form a short back tack of desired length, whereupon the presser feet of the sewing machines are raised and the finished fabric sections are conveyed to the left, to the unloading position shown in broken lines in FIG. 9. During this last mentioned conveying stage, the threads from the sewing machine are either automatically severed to prepare the equipment for a further operation. Immediately, a new infeed cycle may be commenced, as will be readily understood.

Preferably, after the sewing operation has been completed, and the web sections transported to their left-side limit position, the completed web sections are automatically gripped, removed and stacked. For this purpose, the loose draping of the web section permits it to be readily engaged between the transport strips and by the jaws of a stacking device. As soon as the web section is thus engaged, the support panels 35, 71 are retracted downwardly, to release the fabric from the grip of the transport strips 74, 75.

Pursuant to one aspect of the invention, in the feeding of the fabric and the forming of the hems, fabric is fed with its normally "down" side facing to the front of the machine. Its upper hem is then folded "right side up" while the lower hem is folded "upside down". In addition, both of the hems are so folded that the main panel of the hem, hereinafter referred to as the large hem, is narrower than its intended dimension, and the small panel of the hem, hereinafter referred to as the small hem, is of greater width than is intended. However, during the lateral transport of the hem-folded fabric to the sewing station, the small and large hems are progressively adjusted to the desired size, in a manner that maintains the fabric and the hem under a desired degree of tension and control.

Figure 11:
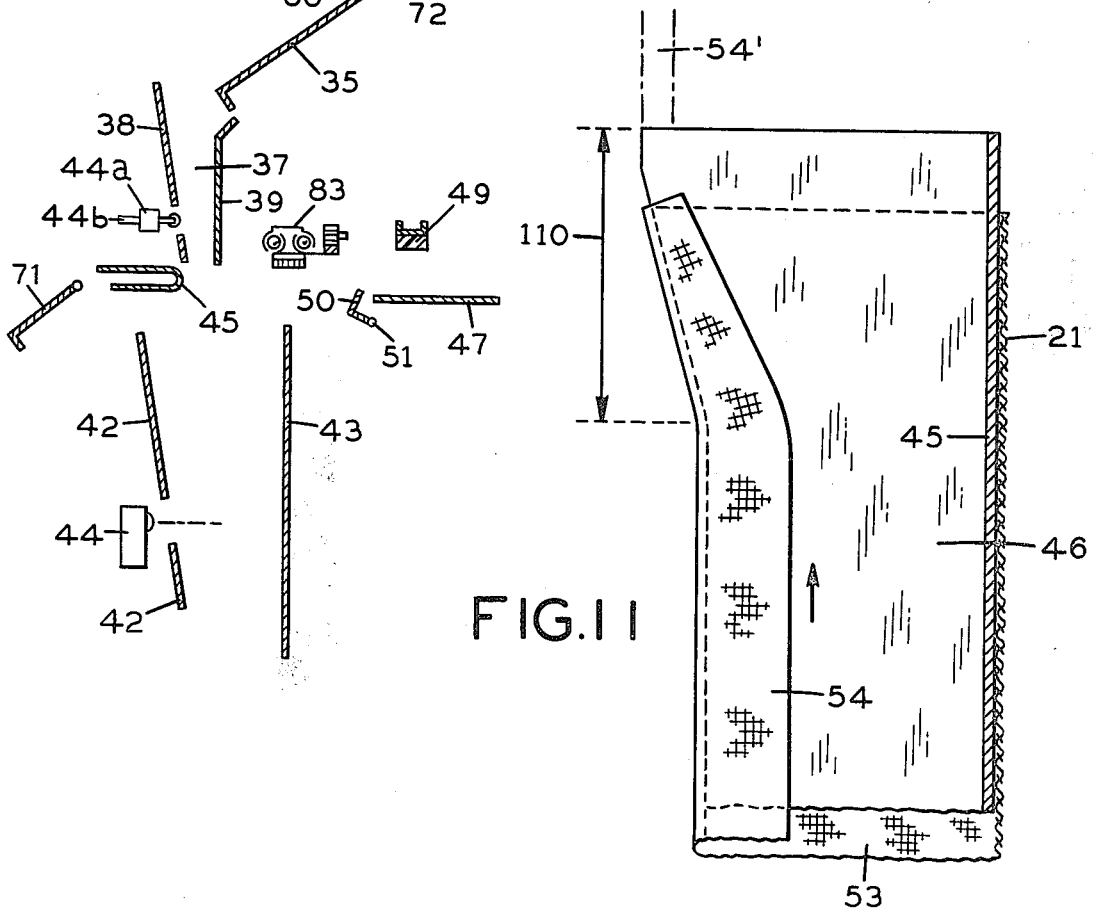
FIG. 11 is a fragmentary cross sectional view illustrating the discharge end region of the hem folding plates of the apparatus of the invention, illustrating the manner in which the folded hem is tensioned and sized immediately prior to sewing.

With reference to FIG. 11, for example, there is shown a cross sectional view of the discharge end extremity of the lower main hem forming panel 46 of the folding bar 45 (it being understood that similar arrangements are provided at the end of the upper hem folding bar 60). After preliminary or initial forming of the hem fold, the large hem panel 53 is narrower than desired, while the tuck-under 54 is wider than desired. Then, as the fabric is transported to the left (upward in FIG. 11) toward the sewing station, the fabric enters a transition section 110 of the folding panel, wherein the main folding panel 46 increases in width to a final desired width dimension of the main hem panel. During this transport phase, the fabric is being held by the transport strips 74, 75, so that the increase in width of the main hem panel 53 necessarily is derived by retracting a portion of the tuck-under 54, which eventually achieves its final desired width 54' indicated in FIG. 11.

This final hem width adjustment is particularly desirable in the context of the invention because it maintains a desired degree of tension in the hem panels of the fabric during the lateral feeding phases, immediately prior to the passage of the folded hem through the sewing station. This controlled tension assures that the fabric hem is maintained under proper control until the sewing has taken place. It is understood, of course, that the initial hem folding operation occurs in a section of the panel 46 laterally adjacent to the transition section 110, and that the illustration of FIG. 11 shows the fabric in a condition in which it has already been displaced laterally into the transition section.

The apparatus and method of the invention incorporate several highly advantageous principles. Truly significant practical advantages are derived from the design of the machine which enables both of the hems to be formed by a pair of vertically stacked, forwardly facing sewing machines, which enable a single operator to observe and attend to both machines very easily. In addition, the described configuration enables sheet hemming or similar operations to be carried out in greatly reduced amounts of factory space, as compared to previous proposals.

The basic design of the apparatus is such that webs of various width are easily automatically accommodated. Thus, in general, the apparatus can handle different width of web by simply readjusting the edge guides and edge detectors, along with appropriate corresponding adjustment in the electronic controls.

One of the specifically significant mechanical features of the invention resides in the use of lightweight, anti-friction transport track arrangements, including relatively conventional anti-friction slide tracks, in conjunction with semi-resilient transport strip material engageable with the surface of the fabric. An extremely effective such material is an elongated strip of resiliently backed pile fabric, which, when slightly compressed, is able to effectively grip the fabric, accommodate all of its minor variations, slide freely over the metal surface of the supporting panels 35 or 71, and reliably advance the fabric. In addition, the arrangement is extremely low inertia, enabling high speed advance, and instant reversal of direction of the fabric, as called for in carrying out back tacking and sewing operations at conventional industrial sewing speeds.

Desirably, the sewing equipment utilizes automatic bobbin replenishing mechanisms of the type described and claimed in the Rovin U.S. Pat. No. 4,117,789, arranged such that each filling of the bobbin is sufficient to enable the sewing of a single hem, and the bobbin is refilled after each operation. In this manner, it is possible to use a lock stitch sewing procedure, without concern of running out of bobbin thread partway through the sewing of a hem and thus producing a defective article. Insofar as is appropriate or necessary, the disclosure of the Rovin U.S. Pat. No. 4,117,789, is hereby incorporated by reference.

The process of the invention is uniquely adapted to the high production commercial manufacture of large fabric panels, such as bed sheets, which are required to be hemmed at opposite ends. In a generally simplified apparatus, vertically oriented to occupy minimum factory space, fabric is fed downwardly by gravity to a control position, following which the fabric is manipulated in a unique manner along its lower edge margin to form both large hem and small hem folds. Then, after measuring off a desired further length of fabric, the generally continuous length of web material is severed, and the severed end region manipulated to form a second hem fold. By feeding of the fabric web with the "wrong side" facing forward and then folding the lower hem "upside down" and the upper hem "right side up", it is possible and convenient to construct the equipment with one sewing machine more or less directly above the other, from which a number of important practical advantages flow.

An advantageous practical feature of the invention resides in the provision, in conjunction with laterally movable transport strips, of upwardly movable fabric supporting panels (35, 71) which, after the fabric has been cut and both hems folded, lift the fabric up into light pressure contact with the transport strips for controlled lateral movement. This preliminary manipulation of the fabric is carried out while the fabric remains clamped at the hem folding bars, but as soon as the fabric has been engaged by the transport strips, the clamps at the hem folding bars are released, to enable free lateral movement of the fabric relative to the hem folding bars and panels, which are fixed against lateral movement.

The design of the equipment accommodates working parts of low mass and inertia, such that the power and energy requirements for operation of the equipment are extremely low. For example, in a typical commercial apparatus for the automatic hemming of bed sheets, the total power requirements are approximately two horsepower, of which approximately one and a half horsepower is related to the sewing machines themselves.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. Apparatus for forming and sewing hemmed bed sheets or the like, which comprises, (a) a supply of web material, (b) a feed roll for controllably advancing said web material, (c) guide means for receiving the advanced material by gravity, (d) control means operative to interrupt the advance of fabric when the leading edge reaches a predetermined location, (e) means for forming and folding a hem across the full width of the material, (f) means for gripping the material in the region of the thus formed hem and transporting the material laterally, (g) means for sewing the hem during the lateral transport of said material.

2. Apparatus according to claim 1, further characterized by (a) said hem forming means being generally stationary and said web material being transported laterally relative thereto, (b) said hem forming means including means for forming large and small hems at said leading edge, and (c) said hem forming means including means for expanding the width of said large hem progressively as said web material is transported toward said sewing means.

3. Apparatus according to claim 1, further characterized by (a) a pair of widely spaced sensors for detecting the downwardly moving leading edge of said web material, (b) separate, widely spaced clamp means for engaging said web material upon sensing of said leading edge by an associated sensor, and (c) hem forming and folding means located between said sensors and said clamp means.

4. Apparatus according to claim 1, further characterized by (a) means for further advancing said web material to form a web section of predetermined overall length, (b) means for severing said web section to said predetermined length, (c) means for forming and folding a second hem across the full width of said web material, (d) second sewing means located generally above the first mentioned sewing means, whereby said hems may be sewed simultaneously one above the other.

5. Apparatus according to claim 4, further characterized by (a) said hem folding means comprising means for forming one of said hems right side up and the other of said hems upside down.

6. Apparatus according to claim 1, further characterized by (a) said transport means comprising a light-weight, low-friction, elongated slide member engageable with the web material across its full width adjacent said hem, and (b) means for controllably moving said slide to carry said web material past said sewing machine while substantially maintaining the integrity of the folded hem.

7. Apparatus according to claim 6, further characterized by (a) a panel cooperable with said slide for slideably supporting web material engaged by said slide.

8. Apparatus according to claim 7, further characterized by (a) said panel being controllably movable into cooperable relation with said slide.

9. Apparatus according to claim 8, further characterized by (a) said panel being pivotally mounted and having a first, downwardly inclined position spaced from said slide and enabling said panel to guide and deflect downwardly moving web material, and an elevated position, slideably supporting said web material in pressure contact with said slide.

10. Apparatus according to claim 1, further characterized by said means for gripping and transporting comprising (a) elongated transport members engaging the material effectively substantially continuously over its full width on one side of the stitch lines to be formed during sewing, (b) separate drive means engaging the material on the opposite sides of said stitch lines, and (c) means for controllably varying the drive speeds of said transport members and said separate drive means, one with respect to the other.

* * * * *